United States Patent [19]

Wettengel et al.

[11] Patent Number: 5,012,395

[45] Date of Patent: Apr. 30, 1991

[54] MODULAR EXPLOSION PROTECTED LAMP FIXTURE MEETING "INCREASED SAFETY" STANDARDS

[75] Inventors: Lothar Wettengel, Künzelsau; Eberhard Langer, Ingelfingen-Criesbach, both of Fed. Rep. of Germany

[73] Assignee: Rstahl Schaltgeräte GmbH, Kunzelsau, Fed. Rep. of Germany

[21] Appl. No.: 498,991

[22] Filed: Mar. 26, 1990

[30] Foreign Application Priority Data

Apr. 12, 1989 [DE] Fed. Rep. of Germany ..... 3911900

[51] Int. Cl.[5] ..... F21V 21/00

[52] U.S. Cl. ..... 362/222; 362/223

[58] Field of Search ..... 362/219, 220, 222, 223, 362/225

[56] References Cited

U.S. PATENT DOCUMENTS 4,323,954 4/1982 Florence et al. ..... 362/223

FOREIGN PATENT DOCUMENTS 1048543 1/1959 Fed. Rep. of Germany .
1054173 4/1959 Fed. Rep. of Germany .
2052416 5/1972 Fed. Rep. of Germany .
3643075 8/1987 Fed. Rep. of Germany .
1547192 10/1968 France ..... 362/223

*Primary Examiner*—Carroll B. Dority
*Attorney, Agent, or Firm*—Frishauf, Holtz, Goodman & Woodward

[57] ABSTRACT

To permit manufacture of totally enclosed "increased safety" light fixtures without requiring specific molds for light fixtures capable of accommodating lamps of different sizes, such as florescent lamps (39), the fixture is assembled of an elongated profiled extrusion structure (2, 9) to which end caps (11) are attached, the extrusion structure having upstanding side walls formed with a groove (24, 25) shaped to receive a piano hinge (4) which is located in a transparent cover (3), the cover and the trough-like portions (2, 9) with the end caps being formed with interengaging projection-and-recess means, with a sealing strip (56) located in the recess. The construction permits manufacture of the trough-like portion of fiber-reinforced plastic, for example glass fiber reinforced polyester, and undercut grooves, as desired, example attachment grooves (45, 46), T grooves (35, 49) to hold locking or retention elements, and internal undercut projections (43, 44) to retain electrical operating elements such as lamps, ballasts and the like.

23 Claims, 2 Drawing Sheets

MODULAR EXPLOSION PROTECTED LAMP FIXTURE MEETING "INCREASED SAFETY" STANDARDS

FIELD OF THE INVENTION

The present invention relates to a lamp fixture meeting "increased safety" standards for placement, for example, in a contaminated or potentially explosive atmosphere, and more particularly to such a light fixture which is easy to make and is assembled of premanufactured parts so that light fixtures for lamps of different power ratings can be made, in modular construction, from essentially similar raw materials or parts.

BACKGROUND

Housings for explosion protected lamps which meet the safety requirements of the International Electrotechnical Commission (IEC) "enhanced safety" standard IP 54, must also meet the following requirements: They must be protected against dust in such a way that ingress of dust, although it may not be totally prevented, does not enter in sufficient quantity to interfere with satisfactory operation of the equipment, here the lamp; and it must be protected against water splashed against the enclosure from any direction, without harmful effect- on the electrical component within the lamp. To permit such lamps to be secured to a support surface, for example the ceiling of a room to be illuminated, it has been customary to form the lamp housing as a single injection molded plastic structure of essentially trough shape, covered by a transparent cover to permit light to be projected from the structure. The trough-like structure retains the electrical components, such as ballasts, switches, sockets for the lamps, radio suppression equipment, and the like, as well as associated wiring. These trough-shaped structures are quite long, and, especially, the longitudinal dimension thereof is large with respect to the wall thickness of the plastic housing structure.

Manufacture of such housing structures is difficult since, based on manufacturing problems, numerous restrictions on the shape of the structure must be accepted, and compromises must be made.

The undesirable and unfavorable relationships between wall thickness and overall dimension inhibits the use of reinforcement fibers, such as glass fibers; or, at best, permits the use of only small glass fibers. Eliminating or substantially reducing fiber reinforcement also substantially reduces the overall strength; the strength of the housing is substantially less than housings which are reinforced with long glass fibers. An injected molded housing of this type must be filled with injection molding material from a plurality of inlets so that the overall composition of the structure, when it is finished, will be non-homogeneous. This, further, reduces the overall strength. If any air bubbles are entrained, during injection, which is very difficult to detect, further weaknesses in the housing will result.

Undercuts, T-grooves and the like, are preferably avoided at the upper part of the trough-shaped housing structure. Such undercuts can be made only by using slider tools in the molds. Such molds are very expensive and are substantially more subject to malfunction or incorrect molding than molds which are free of movable parts. To prevent undercuts, it is necessary to so form the upper parts of the housings to have many edges and projections since, otherwise, undercuts would arise, or that spaces are filled with plastic material which, further, increases production costs.

Based on production problems, the transparent cover can be hinged to the upper trough-like housing portion of the light fixture only at two or three spaced points. The resulting hinged portions, formed on the housing structure and on the transparent cover, are so constructed that the cover is hooked into the housing structure or housing portion. In use, these hinges can become unhooked, which requires some dexterity on part of operating personnel when it is intended to exchange light bulbs, typically fluorescent tubes. These hinge portions, further, are of comparatively low strength and, when the cover is open, are subject to breakage. The closing force with which the cover is closed against the trough-like housing portion, required if the overall structure is to meet the safety requirements of "increased safety" as defined by the international standards (as well as by coordinate ANSI standards)is just barely adequate.

From a production point of view, it is particularly annoying that for each size of lamp fixture, for use with specific sizes of light sources, for example 30 W, 40 W or 60 W fluorescent tubes, it is necessary to provide individual molds, which are very expensive.

In spite of the above disadvantages, explosion-protected housings were usually made of single-element housing portions,although it has previously been proposed to make housings for light sources by fitting together extrusion parts and end caps, for placement in ordinary, potentially non-hazardous environment. Thus, international standard IP 10, for example,protects the lamp only against surfaces greater than 50 mm, that is, large surfaces such as a hand, casually engaging against the light, without any special protection with respect to water.

THE INVENTION

It is an object to provide environmentally protected light fixture, meeting "increased safety" standards of at least the standard of IP 54 (protection against dust and splashing water), which can be made of reinforced plastic material, readily adapted in the manufacture to different sizes of lamps, and which has smooth outer contours easily shaped to permit attachment to wall fixtures by standard clamps or the like.

Briefly, an elongated profiled extruded structure of predetermined length, preferably cut from a long rail, is provided, shaped to provide an open-ended trough-like portion. The length of this structure can be easily determined by being cut off from a long rail, so that sets of light fixtures, identical with respect to length, can be made from a single extruded rail, so that only one extrusion press for the profiled shape is required. Two end caps are provided, secured and sealed to the open ends of the trough-like structure, the end caps, preferably, having a rim shape which matches the rim shape of the rail so that a continuous soft sealing bead can be introduced into the rim portion of the elongated profiled rail structure, which will form the major portion of the housing,to continue in the end cap and provide an effective all-around seal for a transparent cover.

The structure of the present invention has the advantage that an extruded profiled rail, which can be cut to desired length, permits use of only a single extrusion press, which is expensive, and thus permits manufacture of a variety of housings, in modular construction, or sets of housings, entirely independent of the size of the lamp which is to be secured in the housing. Due to the continuous manufacture of the elongated profiled extrusion rail structure, undercuts within the profile, as well as outside thereof, and extending in longitudinal direction, can be readily shaped during manufacture. It is easily possible to make even complex structures having elongated grooves or projections with undercuts during extrusion - that is, to manufacture structures simply and inexpensively which are not possible to make by injection molding even with re-forming or pressing. Thus, any desired numbers of attachment projections or rail portions can be made integral with the extruded structure, so that it is simple to locate attachment elements, brackets or the like at any position in the housing its longitudinal extent thereof, with interengaging fits.

The structure has the additional advantage that, during manufacture of an extruded elongated rail structure, it is easily possible to introduce fiber reinforcements. These fiber reinforcements may be elongated fibers, for example glass fibers or the like, or short fibers, as desired. Long fibers can be readily incorporated during extrusion. The extruded structure, preferably, is a unitary element of generally U or channel shape, in which the side walls and the bottom of the structure are integral. It is then a simple matter to couple cut-off portions of this structure to identical end caps, to form the trough-like housing for the lamp. The selection of the profile is preferably so done that, in cross section, it is roughly U-shaped, in which the leg portions of the U extend parallel to each other and are unitary at one end with a cross element or cross piece forming the bottom. The free ends or rims of the legs extend in parallel along the longitudinal dimension of the housing.

Formation of such a profiled rail permits providing an undercut groove along the rim into which an elongated hinge, such as a piano hinge, can be inserted in order to hold the cover. Since the groove extends over the entire length of the rail, a piano hinge, which is very strong, can be used to connect the cover with the housing. The piano hinge is strong although it requires only a small cross-sectional space. Use of a piano hinge also permits connecting the cover and the housing as an irremovable combination so that, after assembly, the cover cannot be lost, or fall off when it is opened, by severing the cover from the housing.

The hinge is preferably threaded into a groove, formed in the profile, which has an essentially circular portion which merges with a slit having parallel flanks, terminating at the rim of the side walls, that is, at the edges of the legs of the essentially U-shaped cross section of the elongated structure. The cover can readily be sealed against the structure to provide a seal against ingress of dust, water and the like, by forming an additional groove to receive a sealing strip. This groove, formed in each one of the legs, continues into a similar groove formed in the end caps, so that a continuous seal is provided.

The piano hinge provides mechanical protection for the usually somewhat soft sealing material to protect the joint of the cover and the housing. At the side of the housing remote from the hinge, the cover can be formed with a projection engaging in the slit opening into the essentially circular groove in which, on the other side, the hinge is inserted. This provides for an essentially labyrinth engagement between the cover and the side wall, to form protection for the seal and to provide an additional water-rejecting strip. Preferably, the cross-sectional shape, including the grooves, of the two side walls of the extruded structure are the mirror image of each other.

A locking element can readily be provided by forming a holding groove section with overhanging ribs, so that an undercut or T-shaped portion will be formed on the inside of the housing, to permit placing a slider with a hook therein. An operating element, extending laterally of the housing, is then provided to engage a slider, slidable in the T groove. The operating element can be sealed to the outside of the housing, for example by a bellows-like construction, as well known in sealed structures through which an element passes which has a limited movability with respect to the structure.

The entire housing can be easily attached to a ceiling by forming the extruded structure with an external T groove, into which suitable brackets can be slipped. To hold electrical components, such as sockets for fluorescent lamps, ballasts, and other accessory equipment, internally formed facing rims or ribs can be extruded to form part of the elongated profiled extrusion structure. The result will be the formation of a generally rather shallow T groove, defined in part by the inner surface of the structure with a very wide slot, which facilitates assembly of holding elements for the electrical components after the elongated structure is made.

The end caps, similar to the elongated structure, can also be made of fiber or filament reinforced plastic, for example glass fiber reinforced polyester. Guide elements are formed on the end caps in order to ensure their appropriate position against the end portions of the elongated profiled structure. An interengaging fit, for example by a projecting lip on the end cap, can be provided, the end caps being secured to the elongated structure by welding, adhesion and the like. The guide elements are preferably integral with the end caps, the appropriate position of the end caps on the elongated structure being ensured before the bonding between the elongated structure and the respective end cap during manufacture of the housing.

The light transmissive cover, preferably, is formed with a groove, matching the hinge groove in the side wall of the housing, and shaped to receive the second hinge wing of the piano hinge. The cover, further, includes a groove which can accept locking arms or the like, preferably in form of bolts which can be engaged by hook-like locking elements on the housing.

In accordance with a preferred feature of the invention, the cover is additionally sealed against the housing part by forming a circumferential, raised rim thereon, which cooperates with and engages in the seal of the housing, when the cover is closed thereagainst.

The housing structure can be assembled against the ceiling or against another holding wall by, preferably, providing lateral openings at the outside of the cover of the end caps by omitting the undercut of the projecting T rails, so that holding brackets, or holding blocks, with matching grooves formed to fit into the T rails can be inserted and slid longitudinally of the housing structure. Suitable locking elements, such as set screws and the like, on the clamps can lock the clamps in position; alternatively, adhesives and the like may be used.

DRAWINGS

FIG. 1 is a cross-sectional view through an explosion protected ceiling fixture, transversely to the longitudinal extent of the housing structure; and FIG. 2 is a fragmentary perspective top view of the housing structure with an end cap assembled thereto, and illustrating the groove arrangement in perspective as well as placement of internal components and of the locking element.

DETAILED DESCRIPTION

Figure 1:
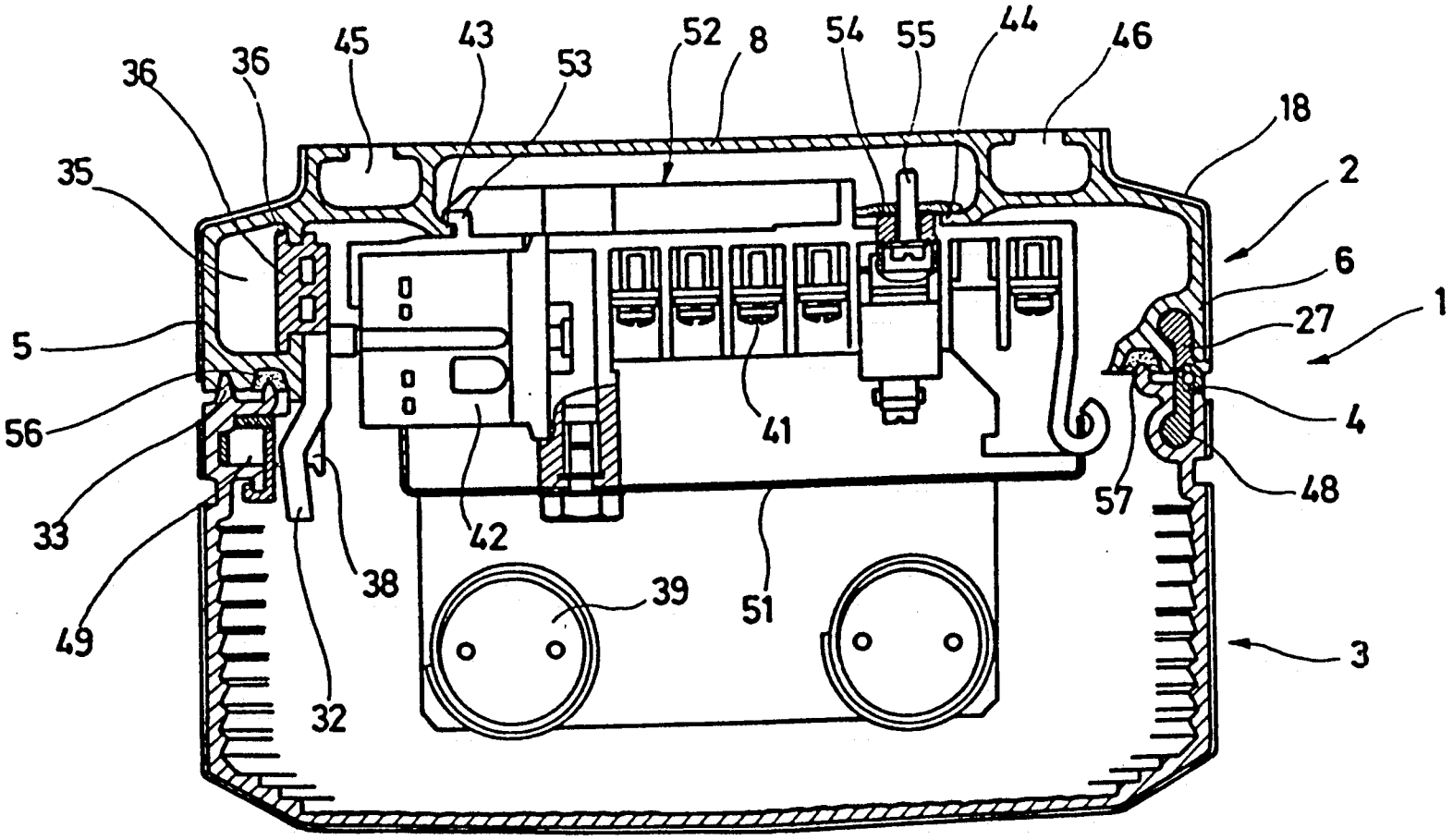

The lamp fixture has a housing 1 which has an upper elongated trough-like portion 2 and a cover 3 which is transparent and, likewise, generally trough-shaped. The cover 3 and the trough-like portion 2 are coupled by a hinge 4, which is, as shown, an elongated piano hinge. The cover 3 and the portion 2 are engaged with meeting rims or edges. The gap between the cover 3 and the housing 2 is sealed in accordance with safety requirements set forth by the IEC standard IP 54.

Figure 2:
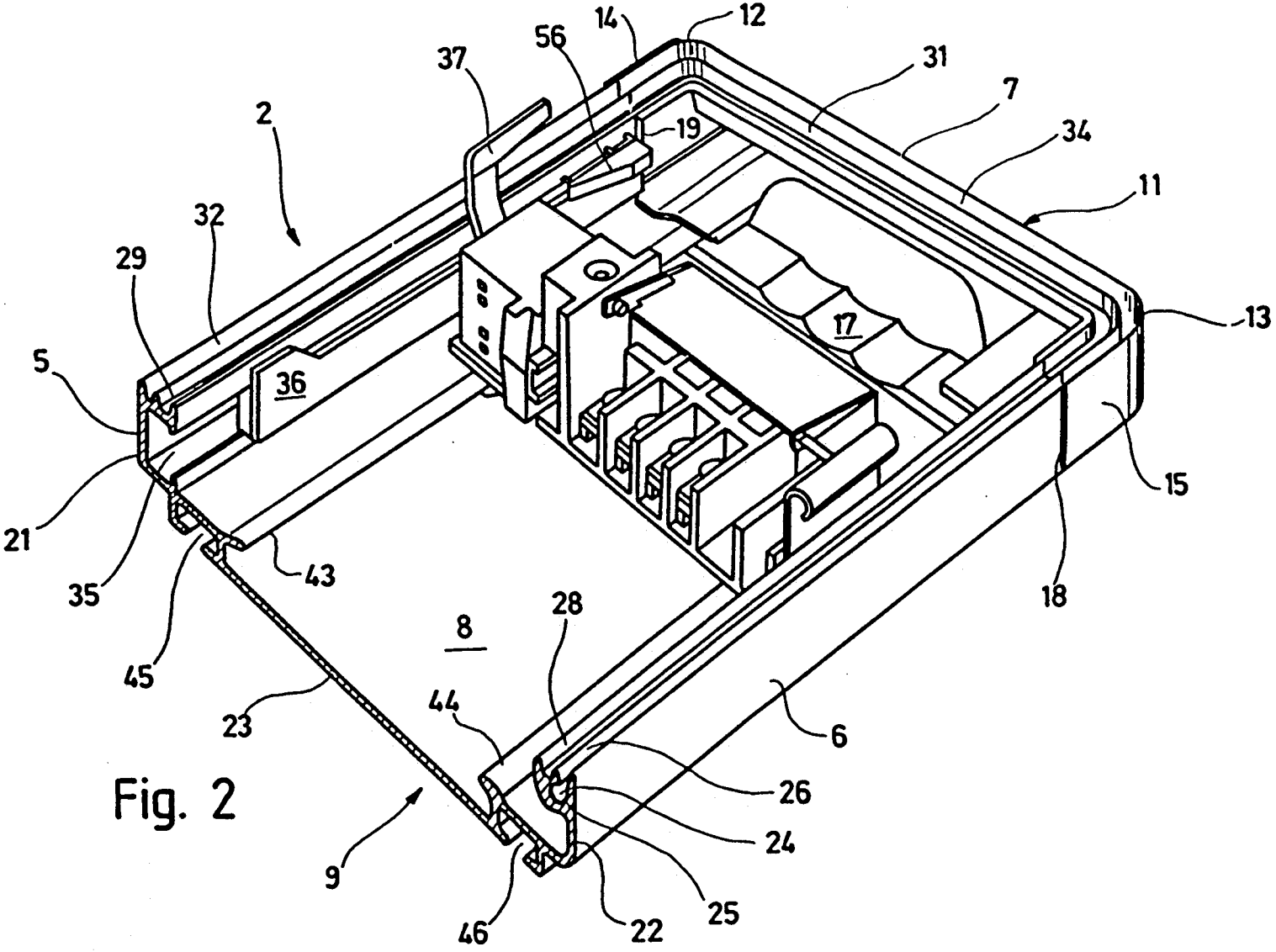

The trough-like portion 2 is formed by a bottom wall 8 and two laterally projecting side walls 5, 6. End walls 7, of which one only is shown in FIG. 2, close off the trough-like portion by caps 11. The fixture is intended to be secured to the ceiling of an area to be illuminated, the top cover 8 fitting, for example, against the ceiling or being adapted for attachment to a hanger structure. The side walls 5, 6, as well as the bottom 8,are formed as a cut portion 9 of an elongated profiled extrusion rail. The extruded rail is made of a glass fiber reinforced plastic, for example glass fiber reinforced polyester. The open ends of the cut rail portion structure 9 are closed off by end caps 11, likewise made of plastic, and preferably fiber-reinforced. The end caps 11 include the respective end walls 7, which extend, beyond rounded corners 12, 13, for some distance to form side wall stubs 14, 15, and a bottom portion 17. The side wall portions 14, 15 as well as the bottom portion 17, essentially, form extensions of the side walls 5, 6 and the bottom 8 of the rail structure 9. They include strip-like extensions 18 or edges 19 which, between each other, accept the open-end edges of the cut portion 9 when the trough-like housing portion 9 is assembled together. The end caps 11 can be placed with the strips 18, 19 on the cut portion 9 and are held by the strips 18, 19 in appropriate position, adjusted to fit against or overlap end regions of the cut portion 9. They are clamped in position until a bonded connection between the cut portion 9 and the end cap 11 has reached the desired strength. Such a bonded connection may be obtained by welding or adhesion. The end caps 11, one at each end of the rail 9, are mirror-symmetrical.

The resulting trough-like portion 2 of the housing has, throughout its extent, the same height, and will define a somewhat rectangular elongated inner space, as best seen in FIG. 2.

The inner space defined by the elongated profiled rail structure 9 has a group of strips, rails and grooves formed therein, which are used to attach or guide mechanical or electrical portions of the fixture. The finished fixture, as shown in FIG. 1, has the portion 9, cut off from an elongated extruded rail, to form two side walls 21, 22 extending upwardly and forming the side walls 5, 6 of the fixture. The rail additionally has a bottom 23 which forms the bottom of the completed housing 1. The three ends of the two legs 21, 22 form the rims of the trough-like portion 2 facing the cover 3.

An elongated groove 24 is formed in the leg 22 of the U-shaped extruded profile 9. Groove 24, in cross section, has a lower,essentially circular portion 25 and a slit 26 extending to the free end of the leg 22, the slit having parallel flanks. The thus formed undercut groove 24 receives one wing 27 of the piano hinge 4.

A second groove 28 is located somewhat inwardly with respect to the free end of the leg 22. Groove 28 has generally trapezoidal cross section. The wider portion may be adjacent the rim of the respective leg 21, 22, as seen in FIG. 1, or may be reversed. The edges of the groove 28 preferably are somewhat higher than the edges of the undercut groove 24 receiving the hinge.

A similar groove, that is, a groove of equal cross-sectional shape and dimension, is located in the leg 21, as seen at 29. Groove 29 is adjacent the free end of the leg 21. The grooves 28, 29, when the trough-like portion 2 is attached to the cap, continue in a groove extension 31 in the end cap 11, so that the grooves 28, 29 are continuously connected by the groove 31. Groove 31 is located at the edge of the end cap 11 facing the cover 3.

Leg 21 has a further groove 32 which, in cross section, may be similar to groove 24 or 29, or, respectively, is of essentially V-shaped cross section. The edges of the groove 32 are at the same level as the edges of the groove 29. Groove 32, together with a rib 33 on the cover 3, forms a water rejecting labyrinth seal or water splash portion, by combination of the rib 33 groove 32. The rib 33 extends into the groove 32 when the cover is closed, as seen in FIG. 1. Groove 32, also, extends into the two end caps 11 and continues in a there formed groove 34, which terminates in the region of the side wall 6 and fits against the slit 26 of the groove 24 and is in alignment therewith. The groove 32 or 34, respectively, has a lesser depth than the groove 24; grooves 32 and 34, respectively, extend in depth only about the length of the slit 26 with the parallel flanks thereof, which receive the wing 27 of the hinge 4. The strip 33 on the cover, likewise, extends up to the ends of the cover around the end portions and up to the hinge within the cover.

An open groove 35 is extruded at the inside of the leg 21, open towards the opposite leg 22. A slider 36, longitudinally slidable within the housing 1, is guided in the groove 35. The slider 36 is formed with suitable undercuts which hold it on the edges of the T groove 35, in form of a dovetail connection.

A locking hook 37 is coupled to the slider 36, which thus forms a locking slider, in order to hold the cover 3 in closed position. The cover 3 has a locking bolt 38 (FIG. 1) formed thereon, which is engaged by the extension hook 37 on the locking slider 36 to press the cover 3 against the troughlike portion 2 and engage the cover in sealed relation against the trough-like portion.

Electrical sockets 39 (FIG. 1), ballasts and accessory equipment, such as radio suppression capacitors, starter elements and the like, terminal strips and clamps 41, and an explosion protected encapsulated switch 42 are secured in the housing 1. To attach all this electrical equipment, the inside of the housing 1 is formed in the region of the bottom 23 of the extruded element 9 with longitudinal strips 43, 44, projecting inwardly and facing each other and which, in combination with the bottom 23, in cross section, form a spreadapart T groove. The T groove has a wide clearance or gap with respect to its depth. The two strips 43, 44 extend above the bottom 23 with only a small distance. The U-shaped extruded profile 9 is formed at the outside of the bottom 23 adjacent the legs 21, 22 with two further :T grooves 45, 46 which, as best seen in FIG. 1, are open to the top so that the fixture can be secured to a sealing or to some other suitable structure. The opening of the grooves 45, 46 extends away from the housing 2 and is adapted to receive suitable coupling elements or brackets which, in turn, attach the fixture at the ceiling or other supports. The bottom 23, as shown, is drawn inwardly or recessed with respect to the legs 21, 22. The depth of the two T grooves 45, 46 corresponds roughly to the spacing of the ribs 43, 44 from the bottom 23.

The grooves 45, 46 extend into the bottom region 17 of the end caps 11 In those regions, however, the outer lateral edges of the T grooves 45, 46 are removed to form openings, the width of which corresponds to the width of the grooves 45, 46 behind the rims, in order to permit introduction of attachment sliders fitting into the T grooves. Such attachment sliders can be introduced into the T grooves 45, 46 from the outside, laterally inwardly, to then be slid into the grooves 45, 46. This arrangement eliminates the formation of additional openings in the region of the elongated rail portion 9 which, apart from cutting a suitable length of portion 9 from a substantially longer extruded profile rail, does not require any additional work or on-the-job adjustments or modifications.

The cover 3 is made of transparant plastic material, for example a polycarbonate. It has a groove 48 which corresponds to the groove 24 and has a mirror-symmetrical cross-sectional shape with respect to groove 24. The two wings of the hinge 4 are located in the respective grooves 24, 48. The two grooves 24, 48 have the same length as the section 9, that is, they extend between the end caps 11. Thus, an elongated hinge, known as a piano hinge, can be used which extends over essentially the entire length of the fixture - that is, at least over the length of the strip 9, leaving off only the end caps 11. The piano hinge 7 is fixed in position in the trough-like portion 2 by the end caps 11, since the groove 24, in the shape shown, does not extend into the end caps; rather, as discussed above, groove 34 is essentially V-shaped. For assembly, one of the end caps 11 is assembled against a strip 9, cut to appropriate length, and then a wing of the hinge 4 is introduced into the groove 24; then the second end cap 11, the appropriate position of which is determined by the strips 18, 19, is coupled to the strip 9 and bonded thereto. Similarly, cover 3 is assembled with the hinge 9. The groove 24 is closed at the ends after the respective wing of the hinge 4 is introduced into the groove 48.

The cover 3 is additionally formed with a groove 49 (see FIG. 1) to receive the locking bolt 38. Preferably, more than one locking bolt is provided. The locking bolts 38 are so attached in the groove 49 that they extend inwardly into the housing 1, positioned for engagement by the hook 37 (FIG. 2).

As best seen in FIG. 1, the extruded profile for the essentially trough-like portion 2 presents at the outside a smooth finish which does not have any protruding corners or edges. Undercuts required to provide attachment surfaces can be easily formed by extrusion, so that the rail-like structure is formed with undercut grooves. Thus, such grooves can be originally readily formed in the housing structure 1, without providing external corners, set-offs or the like. A mounting plate 51, to which the electrical accessory apparatus can be attached, has plastic holding strips or elements 52 thereon which form the actual connection between the mounting plate and the rail 2. It is connected to the rail adjacent the end caps 11, and clamped to the internally projecting strips 43, 44. The plastic elements 52 are formed with a hook-like projection 53 which surrounds strip 43 and, further, is provided with a clamping plate 54 which clamps the plastic element 52 by screw 55 on the strip 44. This positions also the encapsulated switch 42 with respect to the locking slider 36. The locking slider 36 carries an inclined or ramp-like operating wedge 56 (FIG. 2) to operate the switch 42.

Water-tight and dust-tight sealing between the cover 3 and the trough-like housing portion 2 is obtained by an endless rubber ring or rope 56, located in grooves 28, 29, 31 and extending continuously around the trough-like portion 2. When the cover 3 is closed, the rib 57 thereof engages against the rubber ring and compresses the rubber ring to form a tight seal. The outwardly positioned groove 32, together with the rib 33, provides mechanical protection for the soft rubber ring 56 and to prevent mechanical forces from being applied to the rubber ring, for example if power sprays are directed against the lamp. The piano hinge takes over the protective function in the region of the side wall 6 which protects the rubber ring 56 over the entire length of the piano hinge.

The only working step which is necessary to complete the fixture is to provide an opening or bore for an eccenter to permit operation of the locking slider 36 by forming a lateral bore through the rail section 9 in the region of the slider 36.

The sealing ring 56 and the rib 57 have been shown with the ring in the trough-like portion 2 and the rib on the housing 3. The position, of course, of grooves an ribs as well as of the sealing ring can be reversed, by forming a rib comparable to rib 57 in lieu of the groove 28, 29, 31 and a corresponding groove in the cover 3.

Various changes and modifications may be made within the scope of the inventive concept.

What is claimed:

1. Modular, environmentally protected lamp fixture meeting "increased safety" standards, having a housing (1) including a unitary, elongated trough-like body portion (2) formed with side walls (5, 6, 7), each having a rim, and a bottom (8);

a light pervious cover (3);

a hinge (4) secured to the trough-like body portion and the cover, respectively, and pivotably connecting said body portion and said cover.

said cover, when in closed position against said body portion, engaging one of the rims of the body portion;

sealing means (56) between said cover and said body portion along said rim;

electrical operating elements (39, 41, 42) for operation of a lamp means located in said housing; and holding and support means (52) located in said housing for holding and supporting said electrical operating elements, wherein, in accordance with the invention, the trough-like portion (2) comprises an elongated profiled extruded structure of predetermined length, defining open ends and two respectively parallell side walls (5, 6);

wherein said profiled extrusion structure has a cross section of generally U shape defining two generally parallel leg portions (21, 22), forming said side walls, and a bottom connecting portion (23), unitary with said leg portions;

the free ends of said leg portions defining two portions of said rim which extend in a longitudinal direction;

wherein said profiled extrusion structure, adjacent the rim of one of said leg portions (22), is formed with a groove (24) shaped and dimensioned to receive one wing of said hinge (4);

and two end caps (11) are provided, secured to and sealed on the open ends of the extruded structure.

2. The lamp fixture of claim 1, wherein said profiled extrusion structure comprises a fiber reinforced plastic material.

3. The lamp fixture of claim 1, wherein said profiled extrusion structure comprises a plastic material reinforced with glass fibers.

4. The lamp fixture of claim 1, wherein said profiled extrusion structure, throughout its length, has an identical cross-sectional shape and dimension.

5. The lamp fixture of claim 1, wherein said profiled extrusion structure is a portion (9) of an extruded rail or strip profile.

and said portion defines two respectively parallel side walls (5, 6) and the bottom of the trough-like portion of the housing (1).

6. The lamp fixture of claim 1, wherein said groove (24) for the hinge (4) is an undercut groove.

7. The lamp fixture of claim 6, wherein said undercut groove (24) for the hinge (4) has an essentially, in cross section, part-circular portion (25) and a slit (26) having essentially parallel side walls and merging with said part-circular portions, said slit terminating in a free end of the rim.

8. The lamp fixture of claim 1, wherein the hinge (4) is a piano hinge.

9. The lamp fixture of claim 1, wherein the leg portions (21, 22), adjacent their free ends., are formed with an elongated groove (28, 29) adjacent the rim thereof, shaped and dimensioned to receive said sealing means (56).

10. The lamp fixture of claim 9, wherein said end caps (11) are formed with side walls terminating in said rim;

and wherein said end cap side walls are formed with grooves (31)positioned and dimensioned to form a prolongation of the sealing means receiving grooves (28, 29) of the leg portions of the profiled extrusion structure, to form a continuous groove for said sealing means when the end caps (11) are assembled against the open end of the extrusion structure.

11. The lamp fixture of claim 9, wherein that one (21) of the leg portions of the profiled extrusion structure which is opposite the leg portion (22) having the groove to receive the piano hinge is formed with a projecting rib portion to form a water repellent structure and to protect said seal.

12. The lamp fixture of claim 1, wherein one (5; 21) of the leg portions of the profiled extrusion structure is formed with an internal groove (35) positioned inside of said housing and facing the other one (6; 22) of said leg portions;

and a locking slider means (36) for locking said cover is located in said internal groove (35).

13. The lamp fixture of claim 12, wherein said internal groove is an undercut groove and is located in that one (5; 21) of the side walls which is opposite the side wall (6; 22) which is formed with the groove (24) to receive said hinge.

14. The lamp fixture of claim 1, wherein said elongated profiled extrusion structure is formed with two internal projecting ribs (43, 44) located in the vicinity of the bottom connecting portion (8; 23) and extending towards each other, while leaving a reception space therebetween, and a gap with respect to the bottom (8; 23) to form holding projections for said holding and support means (52) for the electrical operating elements.

15. The lamp fixture of claim 1, wherein the bottom connecting portion (8; 23) of the profiled extrusion structure is formed at the outside of said housing with at least one undercut attachment groove (45, 46) to permit attachment of the housing to a support means.

16. The lamp fixture of claim 15,wherein said undercut attachment groove is a T groove.

17. The lamp fixture of claim 1, wherein the end caps (11) comprise a fiber reinforced plastic material, and further include guide means (18, 19) for fitting alignment with the end portions of the profiled extrusion structure (9);

said end caps being bonded to said profiled extrusion structure.

18. The lamp fixture of claim 1, wherein the light pervious cover (3) defines a rim;

and said rim is formed with a hinge accepting groove (48) to receive a wing portion of the hinge (4).

19. The lamp fixture of claim 1, wherein one of said side walls (5) is formed with an elongated undercut groove (35) extending at least in part longitudinally thereof;

wherein a locking slider (36) is located in said groove and slidable therein;

and wherein the cover (3) is formed with an undercut locking element (49) receiving groove, and a locking element (38) is located in said undercut locking element receiving groove, positioned and shaped for operative association with said locking slider.

20. The lamp fixture of claim 1, wherein said light pervious cover (3) is formed with a continuous raised lip (33) positioned and shaped to fit against the sealing means (56) when the cover is closed against the trough-like housing portion.

21. The lamp fixture of claim 15, wherein the end caps (11) are formed with at least one undercut attachment receiving groove (45, 46) which, at least in part, is formed with a lateral opening for insertion of attachment means into said attachment means receiving groove (45, 46).

22. Modular, environmentally protected lamp fixture of claim 1, wherein said elongated profiled extrusion structure of predetermined length is a portion or cut element, severed from an extruded rail or strip and cut to said predetermined length in dependence on dimensional requirements in accordance with the dimensions of at least part of said electrical elements in said housing.

23. A set of environmentally protected modular lamp fixtures meeting "increased safety" standards;

said set comprising a plurality of modular lamp fixtures as claimed in claim 1, wherein the elongated profiled extrusion structures of all the lamps of said set are identical; the end caps (11) are identical; and the predetermined lengths of said elongated profiled extrusion structures of individual lamp fixtures of said set are determined by the dimensional characteristics of at least part (39) of said electrical operating elements (41, 42).

* * * * *

UNITED STATES PATENT AND TRADEMARK OFFICE

CERTIFICATE OF CORRECTION

PATENT NO. : 5,012,395

DATED : April 30, 1991

INVENTOR(S) : Lothar WETTENGEL et al

It is certified that error appears in the above-indentified patent and that said Letters Patent is hereby corrected as shown below:

TITLE PAGE: Section [73] Assignee should read:

-- RSTAHL Schaltgerätе GmbH --

Signed and Sealed this

Fourth Day of January, 1994

*Attest:*

*Attesting Officer*

BRUCE LEHMAN

*Commissioner of Patents and Trademarks*